United States Patent [19]

Doino, Jr.

[11] 4,141,199

[45] Feb. 27, 1979

[54] APPARATUS TO PROTECT THE BREATHING OF A HORSE

[76] Inventor: Francis Doino, Jr., 277 E. Barkley Pl., North Brunswick, N.J. 08902

[21] Appl. No.: 816,718

[22] Filed: Jul. 18, 1977

[51] Int. Cl.[2] ..... B68C 5/00

[52] U.S. Cl. ..... 54/80; 119/129; 128/212

[58] Field of Search ..... 119/129, 130, 131, 133, 119/110, 111, 115; 54/69, 80; 128/212

[56] References Cited

U.S. PATENT DOCUMENTS

| | | | |
|---|---|---|---|
| 281,860 | 7/1883 | Jones | 119/110 |
| 547,110 | 10/1895 | Boucher | 119/133 |
| 3,491,755 | 1/1970 | Barghini | 54/80 |
| 4,044,531 | 8/1977 | Marchello et al. | 128/212 |

*Primary Examiner*—Jay N. Eskovitz

*Attorney, Agent, or Firm*—Kenyon & Kenyon, Reilly, Carr & Chapin

[57] ABSTRACT

The breath protector is adapted to be worn by trotters and pacers and includes a self-supporting cover and a means for mounting the cover between a position over the muzzle of a horse and a position spaced from the muzzle of the horse. A release means for releasing the cover from about the muzzle is actuated by the driver via a cable which extends over the head of the horse. A suitable locking means is provided under the horse's head to secure the cover in the retracted position.

11 Claims, 7 Drawing Figures

17
47
10
13
13
32
32
25"
25'
38
41
45
42
37
46
36
36
35
35
33
20
20
15
18

APPARATUS TO PROTECT THE BREATHING OF A HORSE

This invention relates to an apparatus to protect the breathing of a horse. More particularly, this invention relates to a breath protector to be worn by a horse during racing in cold weather.

With the advent of heated viewing stands at racetracks, it has become popular to race horses, particularly trotters and pacers, in both cold and rainy weather. However, it has been found that horses which race during cold weather have a reduced speed. This is due to the fact that the cold air impairs the breathing of the horse and particularly reduces the lung power of the horse. For example, the time of a horse for a one mile track might well be reduced by two seconds or more.

In order to minimize the effect of cold weather on a horse's lungs and to thereby increase the speed of the horse, attempts have been made to cover over the muzzle of the horse with a protective cover. In this regard, it has been known to place a bubble-shaped cover over the muzzle of the horse and to affix the cover by means of various straps to the head of the horse. However, such a cover is not readily accepted at racetracks since the covers extend from the head of the horse and, as such, may well present an unfair advantage during a close race involving a photo finish. Thus, unless all the horses in a given race wear such a cover, those which wear the cover are provided with an extended "nose" by which a race might be won. Accordingly, the wearing of such covers has not become popular at many racetracks.

Accordingly, it is an object of the invention to provide a cover for protecting the breathing of a horse during a race but which can be removed near the finish of the race.

It is another object of the invention to protect the breathing of a horse during racing in cold weather.

It is another object of the invention to provide a relatively simple cover which can be mounted over the muzzle of a horse during a race and removed immediately prior to the finish of the race.

It is another object of the invention to increase the lung capacity of a horse in cold weather.

Briefly, the invention provides an apparatus for protecting the breathing of a horse particularly trotters and pacers which comprises a rigid self-supporting cover, means for movably mounting the cover on the head of the horse between a first position spaced over the muzzle and a second position spaced away from the muzzle of the horse and a release means releaseably attached to the cover to hold the cover in the first position. This release means is adapted for mounting on the head of the horse and is adapted to be actuated by a driver.

When in use, the cover is disposed over the muzzle of the horse prior to the start of a race. During the race, the cover remains in place until a short distance from the finish line. At this time, the driver actuates the release means so that the cover moves from the position over the muzzle of the horse to a position spaced away from the muzzle of the horse. For example, the cover may swing away from the muzzle of the horse under gravity into a retracted position below the head of the horse and behind the horse's muzzle. In this position, the cover will not cause a false triggering of a camera for a photo finish.

In order to retain the cover in the retracted position, a locking means is provided. This locking means is conveniently incorporated into the means for mounting the cover on the horse as well as in the cover. For example, the locking means may include a metal plate on the under side of the cover and a magnet on a member which extends from the mounting means for holding the cover via the metal plate in the retracted position. Alternatively, the locking means may include a member which extends from the mounting means while a catch is disposed on the cover to releaseably grip the member.

The release means includes a latching plate with a transverse slot which is incorporated in the cover and a latch which engages in the slot and is mounted on the head of the horse. In addition, a cable or like means is provided to disengage the latch from the latching plate. This cable extends over the head of the horse rearwardly to the driver's position so as to be actuated by the driver.

These and other objects and advantages of the invention will become more apparent from the following detailed description and appended claims taken in conjunction with the accompanying drawings in which:

Figure 1:
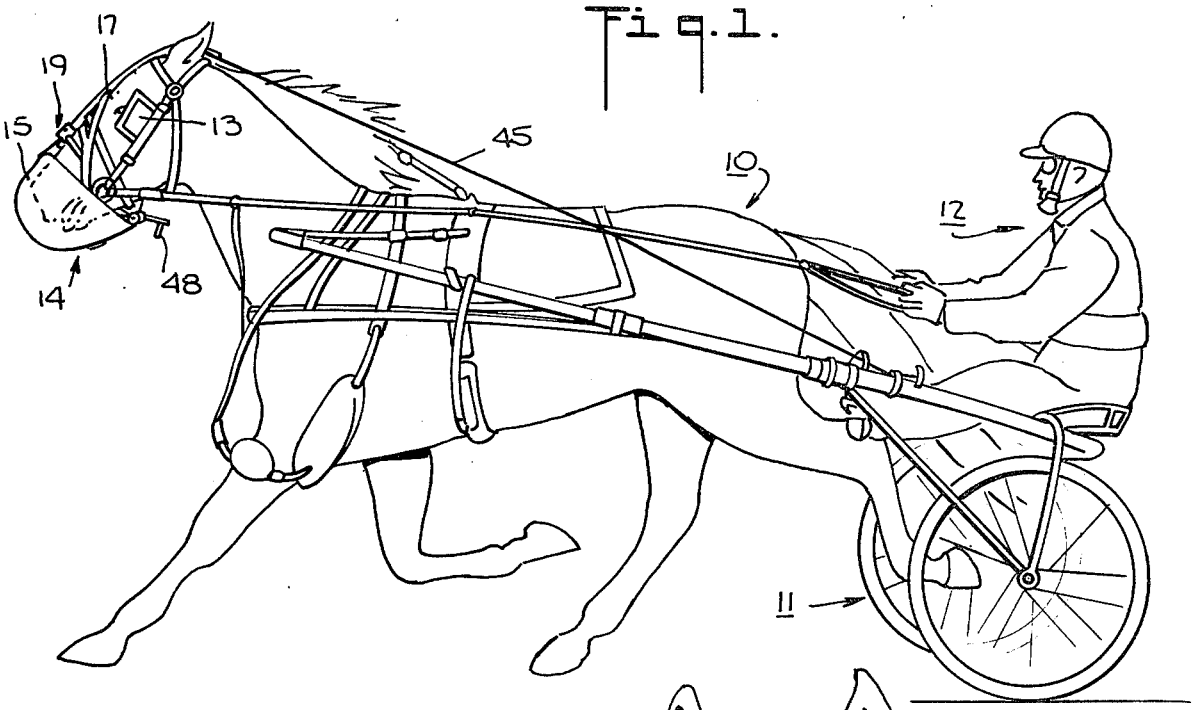
FIG. 1 illustrates a view of a trotter having a protective cover in accordance with the invention.

Referring to FIG. 1, a race horse 10 such as a trotter or pacer is harnessed to a sulky in any known manner so as to be driven by a driver 12. In addition, the horse 10 is provided with the usual equipment for racing, such as with blinkers 13. In addition, the horse 10 is provided with an apparatus 14 to protect the horse's breathing particularly during racing in cold weather.

Figure 2:
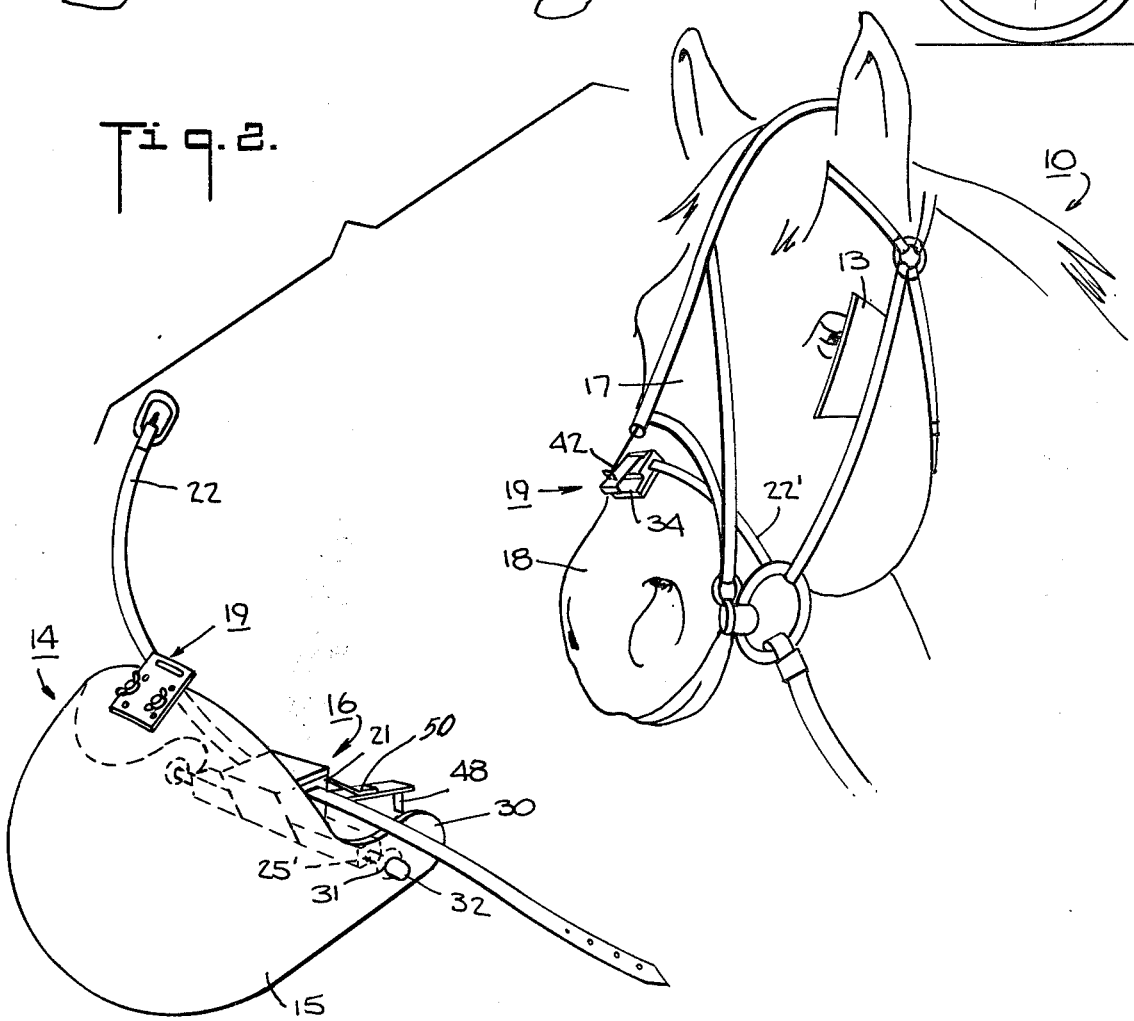
FIG. 2 illustrates an exploded view of the head of the horse and a cover in accordance with the invention.

Referring to FIG. 2, the protective apparatus 14 includes a rigid self-supporting cover 15 of dome shape which is made, for example, of a suitable plastics material. In addition, the protective apparatus 14 includes a means 16 on which the cover 15 is pivotally mounted to permit movement of the cover 15 on the head 17 of the horse 10 between a first position spaced over the muzzle 18 of the horse and a second position spaced away from the muzzle 18. In addition, a release means 19 is provided to releaseably hold the cover 15 in the position over the muzzle 18.

Figure 5:
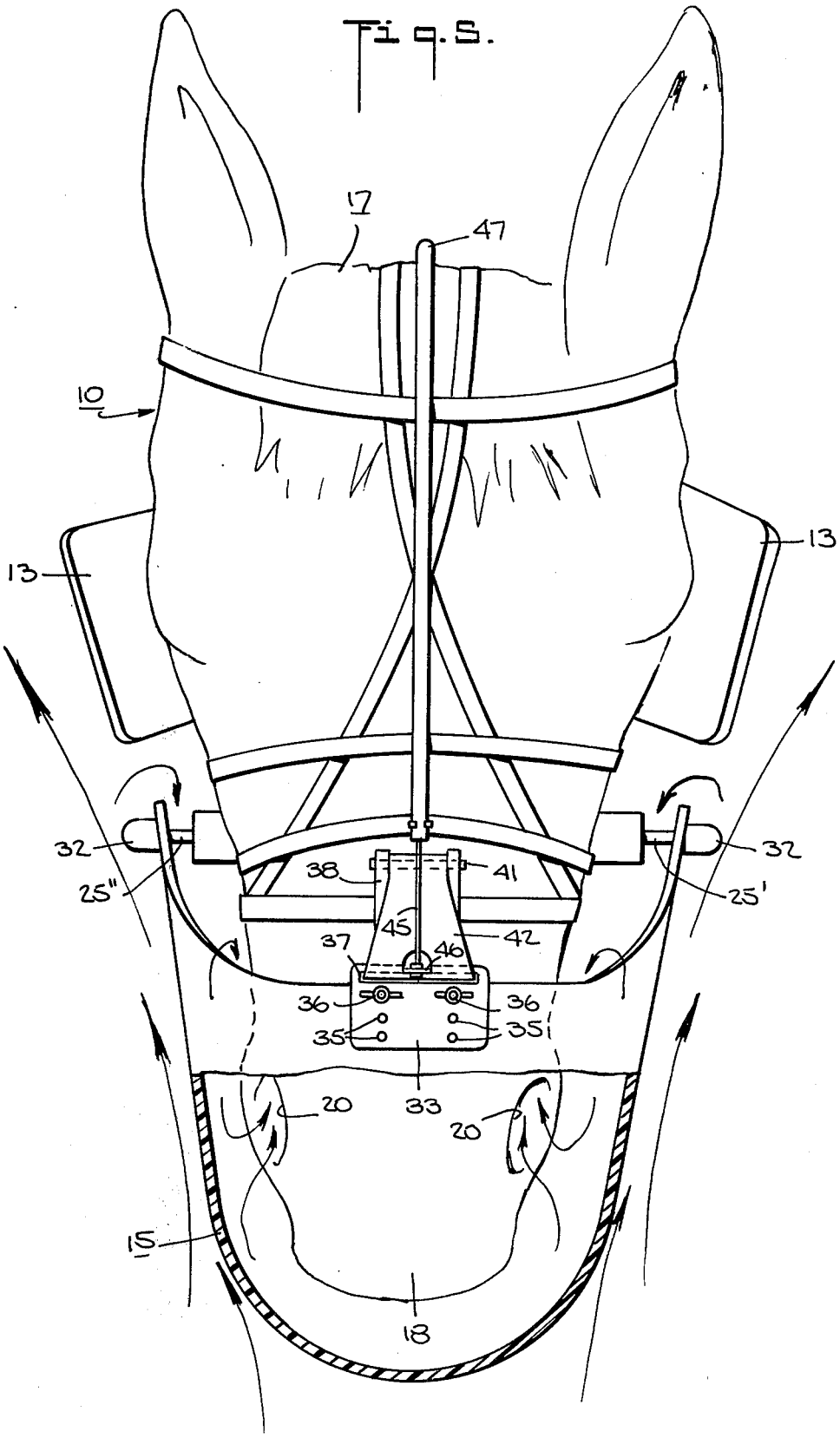
FIG. 5 illustrates a front view of a horse's head with a protective cover in place.

Referring to FIGS. 2 and 5, the cover 15 is of generally smooth contour so as to fit over the muzzle 18 of the horse 10 in spaced relation. The underside of the cover 15 is suitably shaped so as to permit movement of the cover 15 to a retracted position without interferring with the horse's head 17. In addition, the spacing of the cover 15 from the horse's mouth and nostrils is such as to not interfere with the breathing of the horse 10. However, the spacing is sufficient so as to permit warming of the cold air which is drawn in via the nostrils 20 of the horse via the exhaled breath of the horse which is generally much warmer than the surrounding cold air. The warming of the drawn-in air serves to retain the lung capacity of the horse during a race rather than to reduce the lung capacity of the horse. As shown, the cover 15 is made of one piece.

Figures 3, 4:
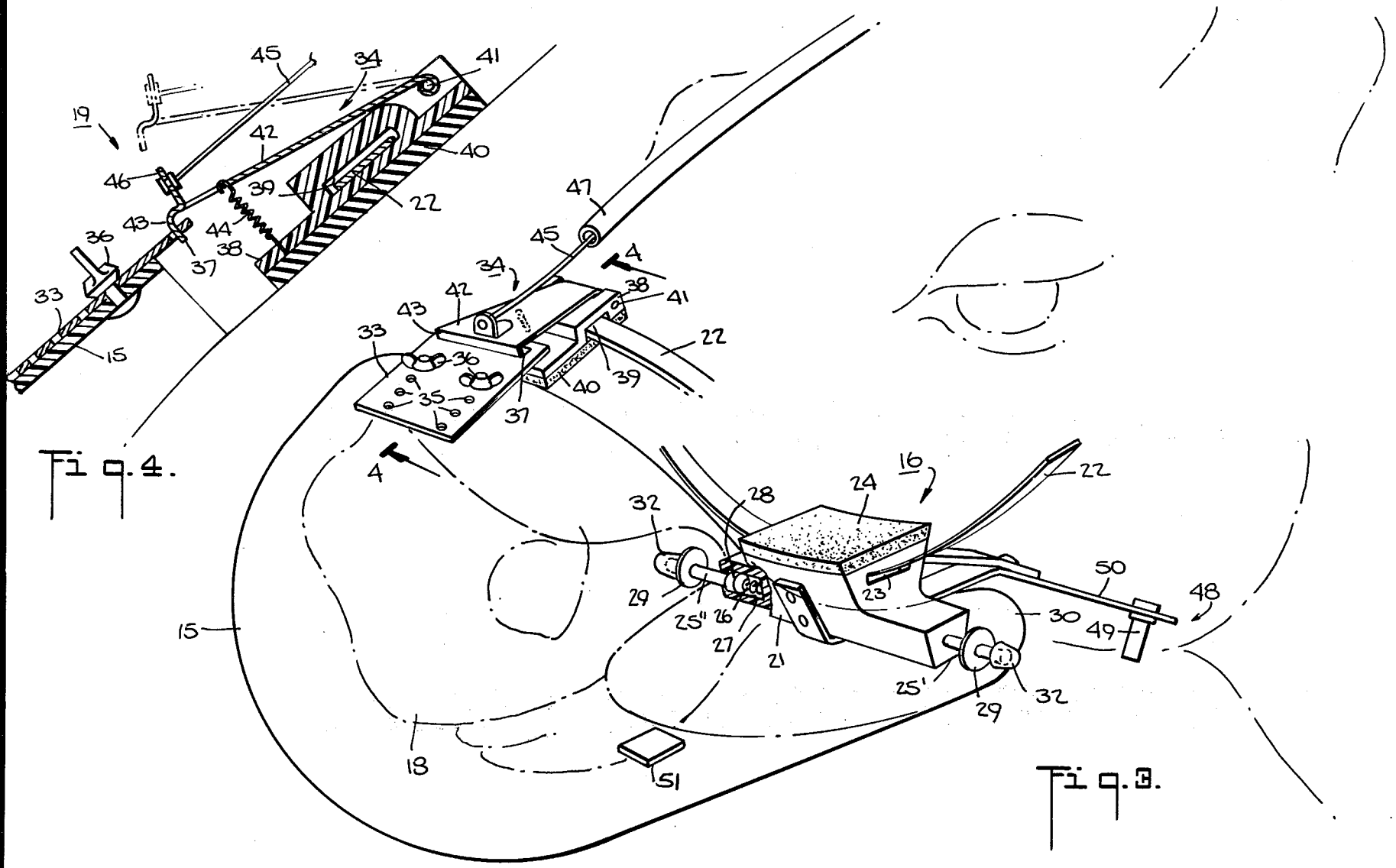
FIG. 3 illustrates an enlarged view of the cover in accordance with the invention.
FIG. 4 illustrates a cross-sectional view of a release means in accordance with the invention.

Referring to FIGS. 2 and 3, the means 16 for mounting the cover 15 on the horse 10 includes a housing 21 and a strap 22 which passes through a suitable slot 23 or the like in the housing 21 and which is sized to envelope the head 17 of the horse. The housing 21 is sized so as to fit on the underside of the horse's head 17 and may include a layer of cushioning material 24 to facilitate a comfortable mounting of the housing 21 in place. In addition, the mounting means 16 has a split axle 25 which is supported by the housing 21 to project outwardly from both sides of the housing 21 in order to mount the cover 15 thereon. As shown, the axle 25 is made of two parts 25', 25''. One axle part 25' is rigidly secured in the housing 21 while the other part 25'' is spring-mounted via a helical spring 26 to slide within a recess 27 of the housing. For this purpose, the housing 21 is provided with extensions on both sides to accommodate the axle parts 25', 25''. The movable axle part 25'' includes an enlarged head 28 of suitable shape to be mounted in the recess 27 and held in place under the force of the spring 26. A rigid disc 29 is fixed to each axle part 25', 25'' to serve as a stop when the cover 14 is mounted on the axle 25. To this end, the cover 15 has a pair of ears or like portions 30 which are provided with one or more apertures 31 through which the axle 25 passes to permit pivoting of the cover 15. By using a plurality of apertures (not shown) the position of the cover 15 over the muzzle 18 of the horse can be adjusted.

In addition, the mounting means 16 includes removable end caps 32 which are mounted on the ends of the axle 25 to retain the cover 15 in a given position on the axle 25.

Referring to FIGS. 4 and 5, the release means 19 is mounted on the forehead of the horse and includes a latching plate 33 on the cover 15 and a latch 34 for engaging the latching plate 33. As shown in FIG. 3, the latching plate 33 includes two sets of holes 35 and is secured via bolts 36 to the cover 15. The holes 35 permit the latching plate to be adjusted relative to the cover 15. In addition, the latching plate 33 includes a transverse slot 37 to receive the latch 34.

Referring to FIGS. 3 and 4, the latch 34 has a base 38 with an aperture 39 through which the strap 22 passes so as to secure the base 38 to the head 17 of the horse 10. In addition, a suitable cushion layer 40 is provided for comfortably affixing the base 38 to the horse's head 17. In addition, the latch 34 has an axle 41 mounted in the base 38 and a latch 41 which is pivotally mounted about the axle 41. The latch 42 includes a downwardly directed lip 43, as viewed, at the forward edge for engaging in the slot 37 of the latching plate 33. Also, a spring means 44 is provided between the base 38 and the latch 42 so as to bias the latch 42 towards the base 38. As such, the spring means 44 serves to retain the lip 43 within the slot 37 of the latching plate 33. In addition, a cable 45 or the like is fixedly attached to the latch 42 via a bracket 46 or the like which extends upwardly from the latch 42. This cable 45 passes over the head of the horse and is held in place by a cable conduit or sleeve 47 and extends rearwardly to the position of the driver 12 (FIG. 1) and serves to pivot the latch 42 from the latching plate 33 to disengage the lip 37 from the latching plate 33 when pulled by the driver 12.

Referring to FIGS. 2 and 3, the protective apparatus 14 also includes a locking means 48 for retaining the cover 15 in the retracted position. To this end, the locking means includes a magnet 49 which is mounted to extend outwardly from the housing 21 of the mounting means 15 and a metal plate 51 which is disposed on the cover 15 to be releaseably held by the magnet 49 when in the retracted position. As shown in FIG. 3, the magnet 49 is mounted via a bracket 50 from the housing 21 so as to be positioned rearwardly of the housing 21 and the cover 15 when the cover 15 is disposed over the muzzle 18 of the horse. Alternatively, the locking means may be formed by a member in the form of an upstanding pin (not shown) on the bracket 50 with a bulbous end while a catch in the form of a spring clip is secured to the cover 14 to engage about the bulbous end of the pin when in the retracted position.

Figure 6:
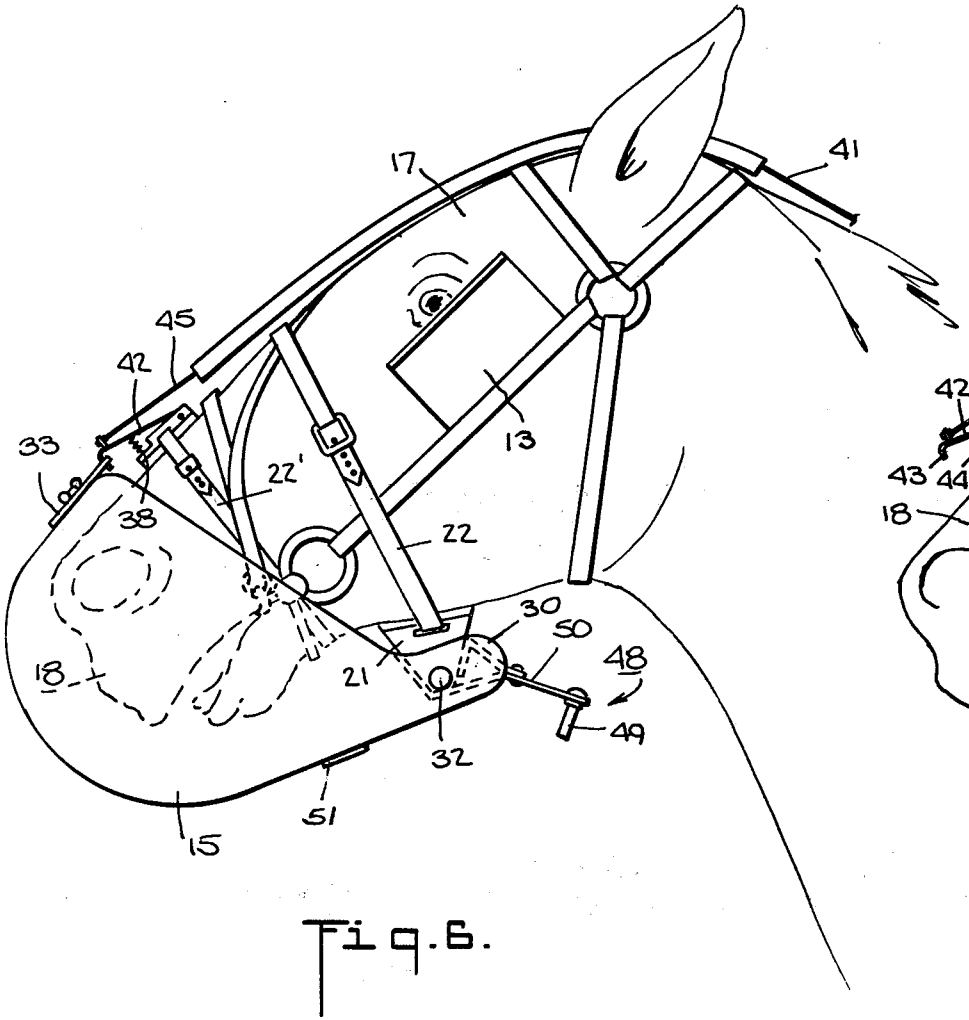
FIG. 6 illustrates a side view of the protective cover in a protective position.

Referring to FIG. 6, the center of gravity of the cover 15 is positioned so that when the cover is released from the latch 42, the cover 15 will swing on the axle 25 rearwardly (counterclockwise as viewed) until the plate 51 engages with the magnet 49 of the locking means.

Figure 7:
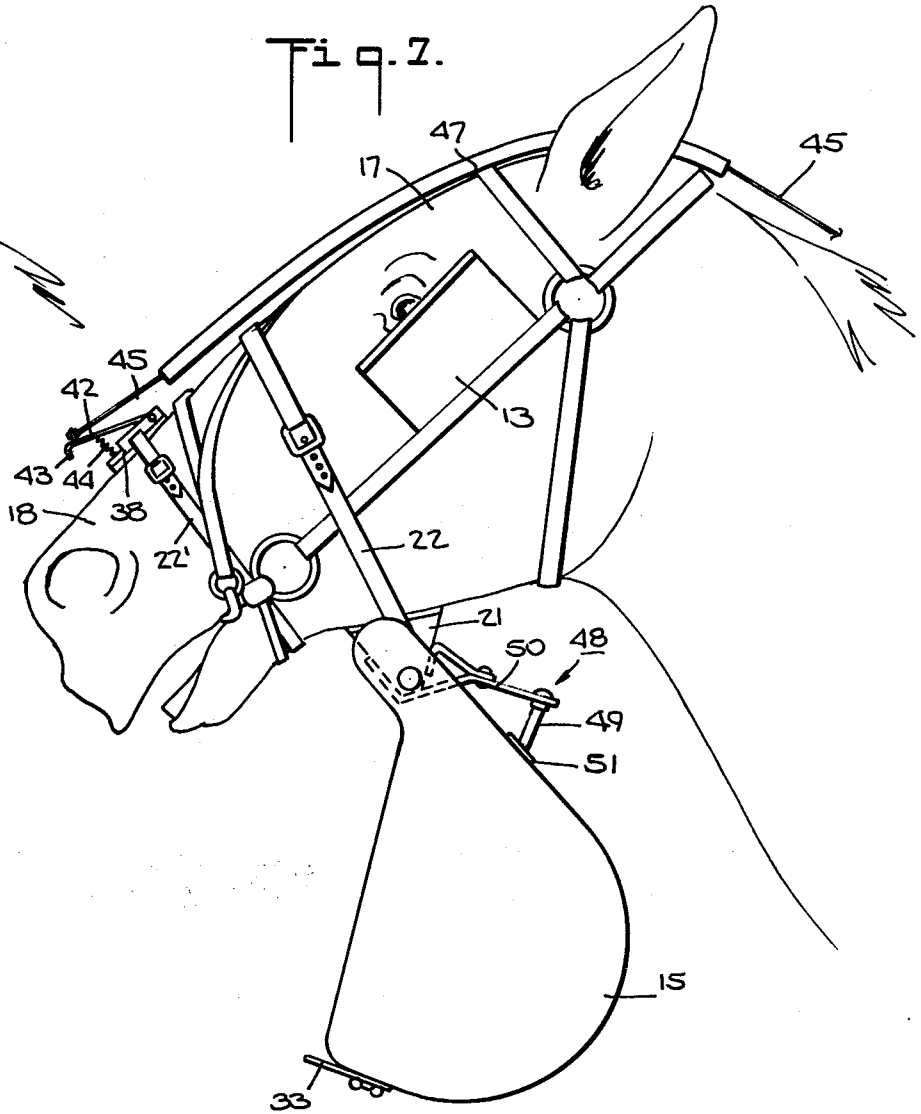
FIG. 7 illustrates a side view of the protective cover in a retracted position.

Referring to FIG. 1, when in use, the protective apparatus 14 is placed over the muzzle 18 of the horse 10 before the start of a race. During the race, the cover 15 remains in place over the horse's muzzle 18 so as to permit warming of the air which is breathed in by the horse by means of the horse's own exhaled breath. Near the end of the race, the driver 12 pulls on the cable 45 to pivot the latch 42 (FIG. 4) out of the latching plate 33. At this time, the weight of the cover 15 causes the cover 15 to pivot about the axle 25 of the mounting means 16 into a retracted position (FIG. 7) at which the locking means 48 retains the cover 15. Thus, at the finish of the race, the muzzle 18 of the horse is uncovered and unencumbered.

Various modifications may be made in the protective apparatus 14. For example, the cover 15 may be provided with suitable cutouts to aid the breathing of the horse. Also, the mounting means for the cover may be secured to the horse by one strap while the locking means is secured to the horse by a second strap 22' (FIG. 2). Further, the axle of the mounting means 16 may be disposed outside of the housing 21 via suitable brackets or may be mounted within the housing 21.

In order to mount the apparatus 14 on a horse, the strap 22 is first enveloped about the horse's head 17 and the mounting means 16 positioned in place along with the release means 19. Thereafter, the cover 15 is mounted on the axle 25 of the mounting means 16. For this purpose, the end caps 32 are removed and the cover 14 fitted over the axle parts 25', 25''. Next, the end caps 32 are replaced to lock the cover 15 on the axle 25. The cover 15 is then pivoted over the muzzle 18 of the horse 10 and attached to the latch 42 via the latching plate 33.

When the protective cover 14 is not required, either the cover 15 can be removed from the axle 25 or the entire apparatus 14 can be removed by releasing the strap 22.

The latch 42 and slot 37 are relatively wide so as to stabilize the cover 15 during a race.

The cover or shield may also be suitable for use on thoroughbreds. In this case, the release cable 45 would be shorter and would have an end secured onto or under a saddle on which a jockey is mounted. In addition, other modifications may be necessary in the reins in order to permit handling of the thoroughbred, for example, when entering a starting gate.

The invention thus provides an apparatus for protecting the breathing of a horse during cold weather so as to avoid to reduction in the horse's lung power and speed. In addition, the apparatus can be used during rainy weather while racing or training. In this case, the apparatus can prevent mud and rain from being splashed into the nostrils of the horse.

What is claimed is:

1. An apparatus to protect the breathing of a horse comprising a rigid self-supporting cover;

means having said cover pivotally mounted thereon to permit movement of said cover on the head of a horse between a first position spaced over the muzzle of the horse and a second position spaced away from the muzzle of the horse; and a release means for mounting on the head of the horse, said release means being releaseably attached to said cover to hold said cover in said first position.

2. An apparatus as set forth in claim 1 which further comprises a locking means for retaining said cover in said second poisition.

3. An apparatus as set forth in claim 1 wherein said first means includes a housing adapted to be fixedly mounted on the underside of the head of a horse; and an axle horizontally mounted in said housing, said axle means having said cover pivotally mounted thereon.

4. The apparatus as claimed in claim 3 wherein further comprises a locking means for retaining said cover in said second position, said locking means including a member extending outwardly from said housing, and a catch on said cover to releaseably grip said member.

5. An apparatus as claimed in claim 1 wherein said release means includes a latching plate on said cover having a transverse slot adjacent a rear edge of said plate and a latch for engaging in said slot of said plate.

6. An apparatus as set forth in claim 5 wherein said release means further includes a base, an axle mounted in said base with said latch rotatably mounted on said axle, said latch having a downwardly projecting lip on the forward edge to engage in said slot in said latching plate, a spring means connected to said base and said latch to bias said latch towards said base, and a cable fixedly attached to said latch to pivot said latch from said latching plate to disengage said lip from said latching plate.

7. An apparatus as set forth in claim 1 wherein said first means has a first strap for securing said first means to the head of a horse and said release means includes a second strap for attaching said release means to the head of the horse.

8. An apparatus as set forth in claim 1 which further comprises a single strap to attach said release means and said first means to the head of a horse.

9. An apparatus as set forth in claim 1 wherein said cover is dome-shaped.

10. An apparatus as set forth in claim 1 wherein said cover is made of plastics.

11. An apparatus as set forth in claim 1 wherein said cover has a center of gravity disposed to permit pivoting of said cover from said first position to said second position under gravity.

* * * * *